US010893344B2

(12) United States Patent
Mikalauskas

(10) Patent No.: US 10,893,344 B2
(45) Date of Patent: Jan. 12, 2021

(54) SPEAKER PANEL

(71) Applicant: Amina Technologies Limited, Huntington (GB)

(72) Inventor: Egidijus Mikalauskas, Huntingdon (GB)

(73) Assignee: Amina Technologies Limited, Huntingdon (GB)

( * ) Notice: Subject to any disclaimer, the term of this patent is extended or adjusted under 35 U.S.C. 154(b) by 265 days.

(21) Appl. No.: 15/632,613

(22) Filed: Jun. 26, 2017

(65) Prior Publication Data

US 2017/0374440 A1 Dec. 28, 2017

(30) Foreign Application Priority Data

Jun. 27, 2016 (GB) ..... 1611151.0

(51) Int. Cl.

| | |
|---|---|
| ***H04R 1/02*** | (2006.01) |
| ***H04R 7/10*** | (2006.01) |
| ***H04R 31/00*** | (2006.01) |
| ***H04R 7/04*** | (2006.01) |
| ***H04R 1/28*** | (2006.01) |

(Continued)

(52) U.S. Cl.

CPC ..... *H04R 1/025* (2013.01); *H04R 1/2892* (2013.01); *H04R 7/045* (2013.01); *H04R 7/06* (2013.01); *H04R 7/10* (2013.01); *H04R 9/06* (2013.01); *H04R 31/003* (2013.01); *H04R 2231/00* (2013.01)

(58) Field of Classification Search

CPC ..... H04R 1/025; H04R 1/2892; H04R 7/045; H04R 7/06; H04R 7/10; H04R 9/06; H04R 31/003; H04R 2231/00

USPC ..... 381/388, 431

See application file for complete search history.

(56) References Cited

U.S. PATENT DOCUMENTS

| | | | | |
|---|---|---|---|---|
| 4,769,188 A | 9/1988 | Graham et al. | | |
| 6,795,561 B1 * | 9/2004 | Bank | ..... | H04R 7/045 381/152 |

(Continued)

FOREIGN PATENT DOCUMENTS

| | | |
|---|---|---|
| EP | 2626536 A2 | 8/2013 |
| GB | 2531942 A | 5/2016 |

(Continued)

OTHER PUBLICATIONS

Jan. 21, 2019—(EP) Communication pursuant to Article 94(3) EPC—App 17178192.5.

(Continued)

*Primary Examiner* — Md S Elahee

(74) *Attorney, Agent, or Firm* — Banner & Witcoff, Ltd.

(57) ABSTRACT

The present application provides a method of manufacturing a resonant panel (200) of a flat panel loudspeaker. The method comprises: pressing a resonant panel blank between a first pressing surface (302) and a second pressing surface of a press, whereby to form the resonant panel (200) of the flat panel loudspeaker. The second pressing surface substantially opposes the first pressing surface (302). The first pressing surface (302) comprises at least one tool relief region (306, 312, 314, 316, 318), whereby to form at least one corresponding respective panel relief region (206, 212, 214, 216, 218) in a surface of the resonant panel (200).

14 Claims, 2 Drawing Sheets

(51) Int. Cl.
*H04R 7/06* (2006.01)
*H04R 9/06* (2006.01)

(56) References Cited

U.S. PATENT DOCUMENTS

| | | | | |
|---|---|---|---|---|
| 2002/0021812 | A1* | 2/2002 | Bank | H04R 7/045 381/152 |
| 2004/0129492 | A1* | 7/2004 | Bertagni | H04R 1/02 181/150 |
| 2006/0018504 | A1 | 1/2006 | Kam | |
| 2008/0285778 | A1* | 11/2008 | Kuroda | G03B 21/565 381/152 |
| 2009/0123692 | A1* | 5/2009 | Kaump | E04F 13/0871 428/99 |
| 2016/0309247 | A1* | 10/2016 | Vanderkley | H04R 1/025 |
| 2017/0055054 | A1* | 2/2017 | Brogan | A45C 11/00 |
| 2017/0374440 | A1* | 12/2017 | Mikalauskas | H04R 7/045 |

FOREIGN PATENT DOCUMENTS

| | | | |
|---|---|---|---|
| JP | H10-210586 | A | 8/1998 |
| WO | 95/01080 | A1 | 1/1995 |
| WO | 98/39947 | A1 | 9/1998 |
| WO | 99/11490 | A1 | 3/1999 |
| WO | 99/52324 | A1 | 10/1999 |
| WO | 00/15000 | A1 | 3/2000 |
| WO | 00/69212 | A1 | 11/2000 |
| WO | 01/03467 | A2 | 1/2001 |
| WO | 01/13676 | A1 | 2/2001 |
| WO | 01/28760 | A1 | 4/2001 |
| WO | 01/74116 | A2 | 10/2001 |
| WO | 2005/101899 | A2 | 10/2005 |

OTHER PUBLICATIONS

Oct. 24, 2018—(GB) Combined Search and Examination Report for Application 1611151.0.
Aug. 11, 2016—(GB) Combined Search and Examination Report for Application 1611151.0.
Aug. 28, 2017—International Search Report and Written Opinion—App PCT/EP2017/065930.
Aug. 28, 2017—(EP) Extended European Search Report—App 17178192.5.
Mar. 7, 2018—(UK) Search Report—App 1611151.0.
Mar. 9, 2018—(EP) Examination Report—App 1611151.0.

* cited by examiner

SPEAKER PANEL

The present application claims priority to GB Application 1611151.0 filed on Jun. 27, 2016, which is incorporated herein by reference in its entirety.

This invention relates to a speaker panel for a flat panel loudspeaker.

BACKGROUND

Flat panel loudspeakers may be installed in a surface, such as a wall, floor, or ceiling, such that a front surface of a resonant panel of the flat panel loudspeaker is substantially flush with the surface. One general appeal of flat panel loudspeakers installed in this way is that a flat panel loudspeaker may be made to look invisible. Once such a flat panel loudspeaker is mounted in the surface of the wall, it is generally intended to make it "invisible" by blending the surface of the wall with a boundary of the flat panel loudspeaker insofar as it is generally not apparent that the flat panel of a loudspeaker forms part of the wall surface. Thus, to provide a panel for the loudspeaker that is flat so that it does not protrude from the surface of the wall, and also lightweight and stiff to allow a strong acoustic response from the excitation of the panel from the rear, a composite panel may be used, for example by using an aluminum honeycomb structure formed between layers of an appropriate skin material, such as a paper.

To make the loudspeakers "invisible" where the surface of walls is to be formed by plastering, e.g. over plasterboard hung on stud walls, the flat panel loudspeaker may be mounted in an opening in the plastered wall to be flush with the wall surface, and then a skim that is applied to finish the plastered wall is also applied over the flat panel of the loudspeaker, thereby giving it substantially the same finish as the wall with which it is flush, making it invisible.

Another form of wall construction that is common in certain markets is drywall lining, in which drywall gypsum boards are attached to stud walls to form the wall surface. The drywall boards themselves provide the wall finish, and so no plastering or finishing skim is applied. Rather, only the joints between the drywall boards are masked by the application of jointing tape and jointing compound to conceal them.

To make the loudspeakers "invisible" where the surface of walls is provided by drywall boards, the flat panel loudspeakers can be mounted in stud walls alongside drywall lining boards. However, due to the taping and jointing, flat composite panel loudspeakers can be more difficult to conceal as the jointing tape can stand proud of the speaker surface.

It is in the above context that the present disclosure has been devised.

BRIEF SUMMARY OF THE DISCLOSURE

In accordance with aspects of the present disclosure, there is provided a method of manufacturing a resonant panel of a flat panel loudspeaker. The method comprises: pressing a resonant panel blank between a first pressing surface and a second pressing surface of a press, whereby to form the resonant panel of the flat panel loudspeaker. The second pressing surface substantially opposes the first pressing surface. The first pressing surface comprises at least one tool relief region, whereby to form at least one corresponding respective panel relief region in a surface of the resonant panel.

In accordance with the above aspect of the disclosure, a flat panel loudspeaker is easily formed having a panel with surface relief features designed to, for example, allow the seating and blending of taping and jointing needed to easily hide the flat panel speaker in a drywall board wall and make it invisible to the user. To achieve this, an inner region of the flat panel loudspeaker resonant panel may have a higher surface relief than an outer region of the resonant panel of the flat panel loudspeaker. Therefore, the outer region of the resonant panel, which surrounds the inner region of the resonant panel, may be formed to be depressed relative to the inner region. As such, the surface form of the flat panel is no longer 'flat', and the edge region may be formed to have a recess, which facilitates the accommodation of the taping and jointing compound to allow the loudspeaker to be more easily made invisible in a drywall. As the panel is pressed, the recess is shaped to be relatively smooth in form as the relief changes from the inner region of the panel to the relatively depressed outer edge, which greatly facilitates the smoothing and blending of the jointing compound into the outer region such that the surface of the inner region can be formed flush with the surface of the wall and made 'invisible'.

Similarly, the flat panel of the loudspeaker can be formed having a localised surface feature, such as a logo or an ornamental design, which can subtly signal the presence and location of the flat panel loudspeaker once it is installed in the wall, to prevent the flat panel loudspeaker being damaged or obstructed.

Further, localised surface relief features may be provided in accordance with this aspect of the disclosure that allow, through the selective application of filler material such as surface skim, to the surface relief, by, for example, filling in a localised depression, to tune or adjust the acoustic response of the flat panel loudspeaker after installation in the surface. Typically, in the prior art, calibration and quality control of the acoustic response of the flat panel loudspeakers is typically defined at the point of design, assembly and shipping of the flat panel loudspeaker. However, the mode of installation may in certain circumstances affect the acoustic response of the loudspeaker. For example, by adding a thick layer of skim over the entire surface of the flat panel of a loudspeaker, weight is added to the panel and the panel is stiffened such that the low frequency response of the panel is suppressed. In accordance with the present disclosure, however, surface relief features, such as localised depressions, may be formed in the surface of the panel which may be designed and configured such that, when selectively filled, the acoustic response of the flat panel loudspeaker may be tuned after installation. For example, by providing localised surface features that allow the installer of the loudspeaker to selectably add mass (such as filler material) in one or more depressions in the front surface of the panel near to the location of the exciter, the user can selectably reduce the low frequency effects on the panel of the pistonic movement of the exciter, thus allowing the user to adjust the response of the loudspeaker, in particular at low frequencies. As such, the shape and location of the localised surface relief features can be chosen to achieve a desired or selectably adaptable audio response when mounted in the surface. In this way, surface relief features can be chosen such that, when filled, a desired audio response is achieved, and the loudspeaker can be calibrated to achieved a desired audio response after mounting. Thus, the method of manufacture of the flat panel loudspeaker is used to form the resonant panel of the flat panel loudspeaker to have surface features provided in high or low relief, without detrimentally affecting the audio performance of the flat panel loudspeaker in use. It will be understood that in some embodiments, the selective filling of surface features provided in high or low relief may replace some or all of the calibration or quality control procedures carried out for flat panel loudspeakers of the prior art during design, assembly and shipping, therefore reducing manufacturing complexity of the flat panel loudspeaker.

The resonant panel blank may comprise: a skin having an outer surface in contact with the first pressing surface; and at least one layer of a pre-preg material provided on an inner surface of the skin, the inner surface being opposite the outer surface.

Thus, the resonant panel may be formed to have a skin providing at least one surface of the resonant panel. The skin may facilitate the blending and smoothing of the jointing tape and compound to give a consistent finish across the surface of the drywall, jointing compound and loudspeaker panel.

The method may comprise laminating the skin to the at least one layer of pre-preg material. Forming the panel from a woven or non-woven pre-preg fibrous mat, that is pre-impregnated with a matrix material such as an epoxy acting to bond the composite fibres together and to the skin, allows the surface form of the panel including the relief features to be made by pressing, whereas this would not be possible with sheet-formed bulk plastics material such as PVC or a composite material such as aluminium honeycomb structure, which would require machining. The press-formed pre-preg panel may be cured by autoclaving to form a stiff, light-weight panel comprising desired surface relief features.

The resonant panel blank may further comprise a further skin having an outer surface in contact with the second pressing surface. The further skin may also have an inner surface provided on the at least one layer of pre-preg material.

A one of the at least one tool relief regions may be a region of low relief, whereby to form a corresponding one of the at least one panel relief regions as a region of high relief.

A one of the at least one tool relief regions may be a region of high relief, whereby to form a corresponding one of the at least one panel relief regions as a region of low relief.

Where a plurality of tool relief regions are provided on the first pressing surface, the tool relief regions may include regions of high relief and regions of low relief.

The region of high relief may extend to a lateral pressing boundary of the first pressing surface, the lateral pressing boundary corresponding to a lateral panel boundary of the surface of the resonant panel.

The region of high relief may extend to substantially all the lateral pressing boundary of the first pressing surface, whereby to form a depressed surface feature along substantially all the lateral panel boundary of the surface of the resonant panel.

One or more of the panel relief regions may define one or more respective localised surface features within the surface of the resonant panel.

The localised surface feature may be bounded inside an inner region of the surface of the resonant panel. The inner region of the resonant panel may be bounded by an outer region of the surface of the resonant panel.

The first pressing surface may be defined by a pressing insert, the pressing insert being provided on a separate pressing plate.

Viewed from another aspect, the present disclosure provides a flat panel loudspeaker for mounting in a mounting surface. The flat panel loudspeaker comprises a speaker unit comprising a resonant panel. The resonant panel has a front surface arranged to face outwardly in the mounting surface when the flat panel loudspeaker is mounted in the mounting surface and a rear surface opposite the front surface. The front surface or the rear surface comprises at least one panel relief region. The resonant panel is formed by moulding or pressing.

Thus, there is provided a flat panel speaker having good audio performance and able to be formed to include surface features on the surface of the resonant panel.

The panel relief region may be on the front surface and may extend to a lateral boundary of the front surface.

The front surface may comprise an inner region and an outer region surrounding the inner region. The panel relief region may extend from an intersection boundary between the inner region and the outer region to the boundary of the front surface.

The flat panel loudspeaker may be provided having a localised surface feature located within an inner region of the flat panel loudspeaker.

The panel relief region may be a depression. The depression is formed to have a substantially uniform depth. A depth of the depression may be less than 2 millimetres. A depth of the depression may be less than 1 millimetre.

Viewed from another aspect, the present disclosure provides a flat panel loudspeaker for mounting in a mounting surface. The flat panel loudspeaker comprises: a speaker unit comprising a resonant panel. The resonant panel has a front surface arranged to face outwardly in the mounting surface when the flat panel loudspeaker is mounted in the mounting surface. The front surface comprises an inner region to be mounted substantially flush with the mounting surface in use, and an outer region surrounding the inner region. The inner region has defined therein at least one localised surface feature bounded inside the inner region.

Thus, a flat panel loudspeaker may be provided having a localised surface feature located within an inner region of the flat panel loudspeaker. Prior art flat panel loudspeakers have not comprised such localised surface features.

It will be understood that a localised surface feature is any 3-dimensional surface feature formed in the panel itself and bounded by the panel material, rather than, for example, additional material or features being adhered to the panel itself, including a high relief region or a low relief region, which is a surface feature within a substantially planar surface of the resonant panel. The localised surface feature on the front surface or the rear surface of the resonant panel may cover a percentage coverage less than 50 percent of the total surface area of the front surface or the rear surface respectively. The percentage coverage may be less than 30 percent. The percentage coverage may be less than 10 percent.

One or more of the at least one localised surface features may be a protrusion extending outwardly from the front surface.

One or more other of the at least one localised surface features may be a depression extending inwardly within the front surface.

A shape of the depression may be arranged such that during mounting it is selectably at least partially fillable to selectably tune an audio response of the resonant panel of the flat panel speaker. The audio response may be selectably tuned by modifying a weight of the resonant panel.

A depth of the depression may be arranged such that during mounting it is selectably at least partially fillable to selectably tune an audio response of the resonant panel of the flat panel speaker.

A position of the depression may be arranged such that during mounting it is selectably at least partially fillable to selectably tune an audio response of the resonant panel of the flat panel speaker.

A shape, depth and/or position of the depression may be arranged such that during mounting it is selectably at least partially fillable to selectably tune an audio response of the resonant panel of the flat panel speaker.

Thus, the audio response of the resonant panel can be customised during mounting to exactly match the needs of a user, or the environmental conditions of the flat panel loudspeaker.

The shape, depth and/or position of the depression may be configured such that when filled, the audio response is changed in a predetermined way.

Similarly, one or more localised surface features may be formed in the surface of the panel having a shape, depth and/or position such that, when mounted in the surface of the wall and finished, a desired acoustic response is achieved. In this way, the acoustic response of the flat panel loudspeaker can be calibrated to achieve a desired response after mounting and finishing.

The depression may be formed to have a substantially uniform depth. In some embodiments, the depression may define a 3D shape having a substantially non-uniform depth.

A depth of the depression may be less than 3 millimetres. A depth of the depression may be less than 2 millimetres. A base of the depression may be rounded.

One or more of the at least one localised surface features is an ornamental design. The ornamental design may be a logo.

A size of one or more of the localised surface features may be less than 5 percent of the surface area of the front surface of the resonant panel.

One or more of the at least one localised surface features may be a word.

The speaker unit may further comprise an exciter mounted to a rear surface of the resonant panel via an exciter foot. One or more of the at least one localised surface features may be positioned substantially adjacent to a position of the exciter foot.

The resonant panel may comprise a skin defining the front surface of the resonant panel. The skin may be formed from a woven material. The skin may be formed from a paper-based material. The skin may be formed from paper. Thus, during mounting, an installer can plaster over a portion of the skin of the resonant panel. Plaster adheres particularly well to a paper skin, even in thin layers of plaster. In some embodiments, the skin may be formed from a woven fabric. The provision of such a skin on the surface of the panel may facilitate blending and hiding of the flat panel loudspeaker to achieve a consistent finish when mounted and finished in a drywall with jointing tape and compound.

The present disclosure also provides a method of mounting a flat panel loudspeaker in a mounting surface. The flat panel loudspeaker comprises a speaker unit comprising a resonant panel, the resonant panel having a front surface arranged to face outwardly in the surface when the flat panel loudspeaker is mounted in the surface and a rear surface opposite the front surface. The front surface or the rear surface has defined therein at least one depression extending inwardly within the resonant panel. The method comprises: locating the flat panel loudspeaker within a mounting opening provided in the mounting surface; and tuning an audio response of the resonant panel of the flat panel loudspeaker by selectively filling in at least one depression.

BRIEF DESCRIPTION OF THE DRAWINGS

Embodiments of the invention are further described hereinafter with reference to the accompanying drawings, in which.

DETAILED DESCRIPTION

Figure 1:
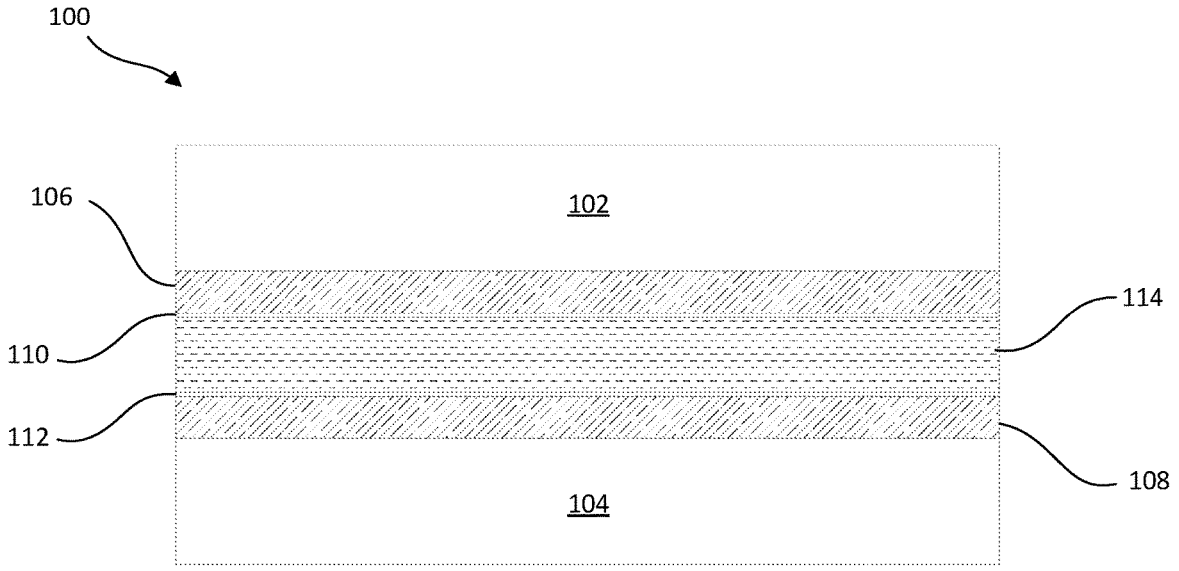
FIG. 1 is a diagram of a layer structure of a manufacturing assembly used to produce a resonant panel for a flat panel loudspeaker as disclosed herein.

FIG. 1 is a diagram of a layer structure of a manufacturing assembly used to produce a resonant panel for a flat panel loudspeaker as disclosed herein. The manufacturing assembly 100 is for use in a press used to form resonant panels for flat panel loudspeakers. The press comprises a first press plate 102, spaced apart from a second press plate 104. The first press plate 102 is provided with a first tool plate 106 on an inner surface thereof. The second press plate 104 is provided with a second tool plate 108 on an inner surface thereof. A pressing cavity (not shown) is defined between a first pressing surface and a second pressing surface provided by facing surfaces of the first tool plate 106 and the second tool plate 108. The pressing cavity defines a mould for forming the resonant panel of the flat panel loudspeaker. The resonant panel is formed from a resonant panel blank. The resonant panel blank is shown as the layers 110, 114, 112 between the first tool plate 106 and the second tool plate 108 in FIG. 1. The resonant panel blank comprises a first skin 110 and a second skin 112. One or more layers of pre-preg material 114 of woven or non-woven composite fibres pre-impregnated with a matrix bonding material is provided between the first skin 110 and the second skin 112. During operation of the press, the first skin 110 and the second skin 112 are each bonded to an outer surface of the one or more layers of pre-preg material 114.

The first press plate 102 and the second press plate 104 are each typically heated, whereby to heat the first tool plate 106 and the second tool plate 108 during a pressing operation. In turn, this heats the resonant panel blank and promotes bonding of the first skin 110 and the second skin 112 with the outer surface of the one or more layers of pre-preg material 114 whilst also curing the pre-preg material 114.

The first tool plate 106 and the second tool plate 108 are typically formed as separate plates to the first press plate 102 and the second press plate 104 respectively, but it will be understood that the first press plate 102 and the first tool plate 106 may be integrally formed as a single plate. Similarly, in some examples, the second press plate 104 and the second tool plate 108 may be integrally formed as a single plate.

The exact shape of the facing surfaces of the tool plates 106, 108 is described further with reference to FIG. 3 below.

The first skin 110 and the second skin 112 are each formed from a paper-based material. In this example, a thickness of the paper is approximately 0.3 mm. It will be understood that thicker or thinner paper may alternatively be used. The use of paper facilitates adhesion between the resonant panel and plaster or jointing compound used to conceal the boundary of the resonant panel when the flat panel loudspeaker is mounted in a mounting surface such as a wall. It will be understood that in some examples other materials can be used to for the skin(s), for example woven materials.

The one or more layers of pre-preg material 114 is in an example a single layer of a part-cured non-woven fibre matt in a resin. The thickness of the layer of pre-preg material 114 is approximately 1 millimetres. Pressing the resonant panel blank in the press fully cures the pre-preg material 114 whereby to form a substantially solid resonant panel from the resonant panel blank. In a particular example, the pre-preg material 114 is a non-woven fibre glass matt comprising a part-cured resin suspending the matt of glass fibres. Prior to full curing, the pre-preg material is malleable and tacky. It will be understood that the pre-preg material could use other fibres instead of glass fibres, for example carbon fibre, carbon nano tubes, or organic materials such as fibres from plants such as cotton or flax.

In some examples, the one or more layers of pre-preg material 114 comprises a plurality of layers of pre-preg material. At least one of the plurality of layers of pre-preg material can be a woven layer of pre-preg material. A woven material typically expands less than a non-woven layer of pre-preg material during curing. Furthermore, a woven layer of pre-preg material may be stiffer than the non-woven later of pre-preg material.

To prepare the pre-preg material 114, a liquid phenolic resin is poured over the non woven fibre matt described previously. The material mixture is partially cured in a first stage curing process by heating the material at a predetermined temperature for a predetermined time. Following this, the pre-preg material is malleable, but tacky, and may be stored in this state for a number of days, for example in a cooled environment. It will be understood that alternative resins can be used such as melamine based resins to form the pre-preg material.

Once the form of the panel is created by pressing, it can be cured to form a stiff, lightweight board by heating in an autoclave or press. After this, the panel may be finished (e.g. the edges may be trimmed) and mounted to the exciter and chassis structure (not shown) components to assemble the flat panel loudspeaker.

Figure 2A:
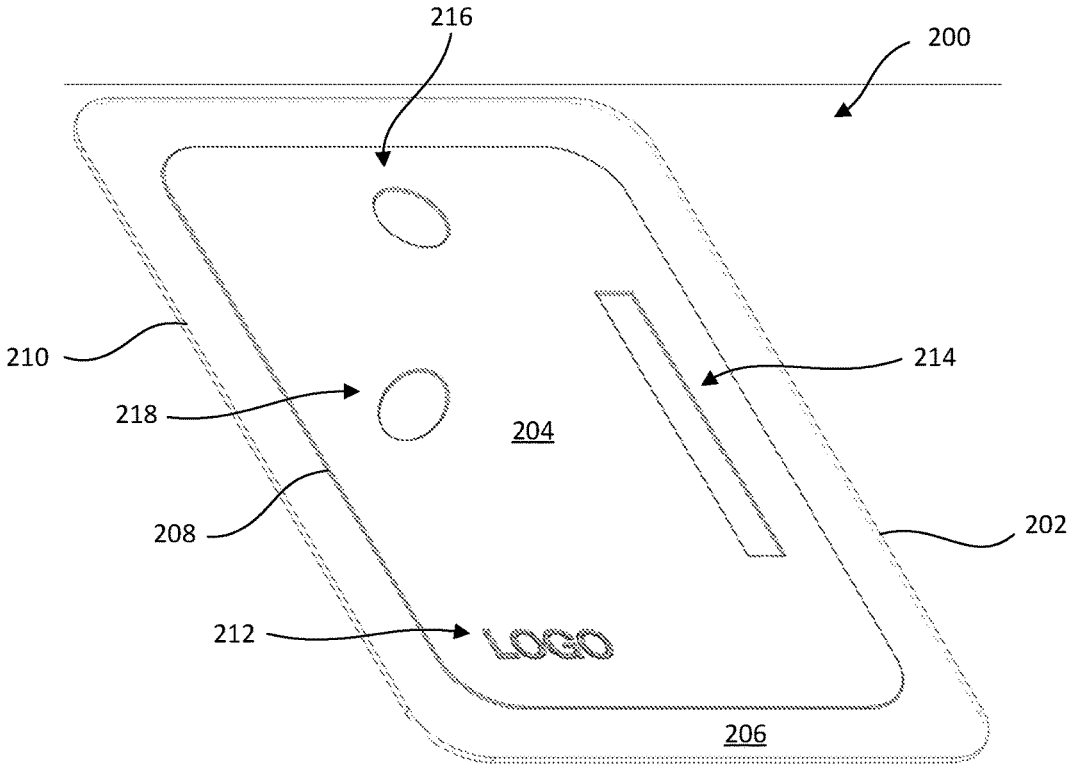
FIGS. 2A and 2B are illustrations of a resonant panel of a flat panel loudspeaker as disclosed herein.
Figure 2B:
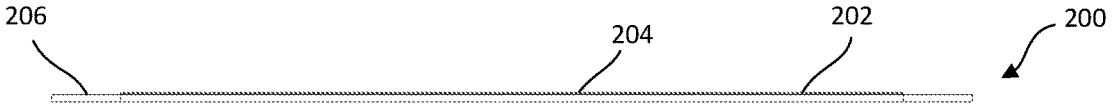

FIGS. 2A and 2B are illustrations of a resonant panel of a flat panel loudspeaker as disclosed herein, viewed from different perspectives. The resonant panel 200 was formed using the manufacturing assembly 100 described previously with reference to FIG. 1. The resonant panel 200 comprises a front surface 202 to face substantially outwards from a mounting surface when the flat panel loudspeaker is mounted in the mounting surface. The front surface 202 comprises an inner region 204 and an outer region 206. The outer region 206 surrounds the inner region 204. The outer region 206 borders the inner region 204 at an interface 208. The outer region 206 extends outwards from the interface 208 to a resonant panel boundary 210. The outer region 206 is formed to have a low relief compared to the inner region 204. It will be understood that this can alternatively be expressed as the inner region 204 being formed to have high relief compared to the outer region 206. Within the inner region 204 there are defined a plurality of localised surface features 212, 214, 216, 218. In this example, all of the localised surface features 212, 214, 216, 218 are shown having low relief relative to the inner region 204, but it will be understood that some or all of the localised surface features could be formed to have high relief relative to the inner region 204. In particular, the plurality of localised surface features include a word "LOGO" surface feature 212 positioned in a lower left region of the inner region 204. The word surface feature 212 is a depression extending within the front surface 202 of the resonant panel 200 to a maximum depth of 2 millimetres. An innermost surface of the word surface feature 212 is rounded. A rectangular-shaped surface feature 214 is provided in a centre-right region of the inner region 204. The rectangular-shaped surface feature 214 is positioned such that a longitudinal length of the rectangular-shaped surface feature 214 extends along a right side of the inner region 204. The rectangular-shaped surface feature 214 is a depression extending within the front surface 202 of the resonant panel 200 to a uniform depth of 2 millimetres. A first oval-shaped surface feature 216 is provided in a centre-top region of the inner region 204. The first oval-shaped surface feature 216 is a depression extending within the front surface 202 of the resonant panel 200 to a uniform depth of 2 millimetres. A second oval-shaped surface feature 218 is provided in a centre-right region of the inner region 204. The second oval-shaped surface feature 218 is a depression extending within the front surface 202 of the resonant panel 200 to a uniform depth of 2 millimetres. It will be understood that more or fewer localised surface features may be provided on the resonant panel 200, in particular on the front surface 202 of the resonant panel 200, and more particularly in the inner region 204 of the front surface 202.

It will be understood that although the example discusses a uniform depth of 2 millimetres for the rectangular-shaped surface feature 214, the first oval-shaped surface feature 216 and the second oval-shaped surface feature 218, the depth may be anywhere from 0.5 millimetres to 2 millimetres.

When the localised surface features are depressions extending within the surfaces of the resonant panel 200, the location, shape, and size of the localised surface features can be chosen specifically to provide a predetermined effect to the audio response of the resonant panel 200 when the depressions are filled. In the present example, the depressions are designed to be filled with plaster, having a known density. However, it will be understood that the depressions could instead be configured to be filled with other materials, or with a range of materials, in order to produce a predetermined and desired tuning of the audio response of the resonant panel 200.

In this example, a rear surface (not shown) of the resonant panel 200 is substantially planar and devoid of localised surface features. It will be understood that the rear surface of the resonant panel 200 may comprise localised surface features for use in tuning the audio response of the resonant panel 200 as described previously.

In some embodiments, the localised surface features are intended to have a minimal effect on the audio response of the resonant panel 200, but are intended to allow the location of the resonant panel within the mounting surface to be observed for a period after mounting. Where the localised surface features are depressions, an installer may then fill in the depressions once further works have been completed to the mounting surface in which the flat panel loudspeaker is located. In this way, the depressions can be selectively filled in to substantially selectively hide the flat panel loudspeaker within the mounting surface. For example, an installer may need to install a mounting bracket for a television into a wall surface.

Figure 3:
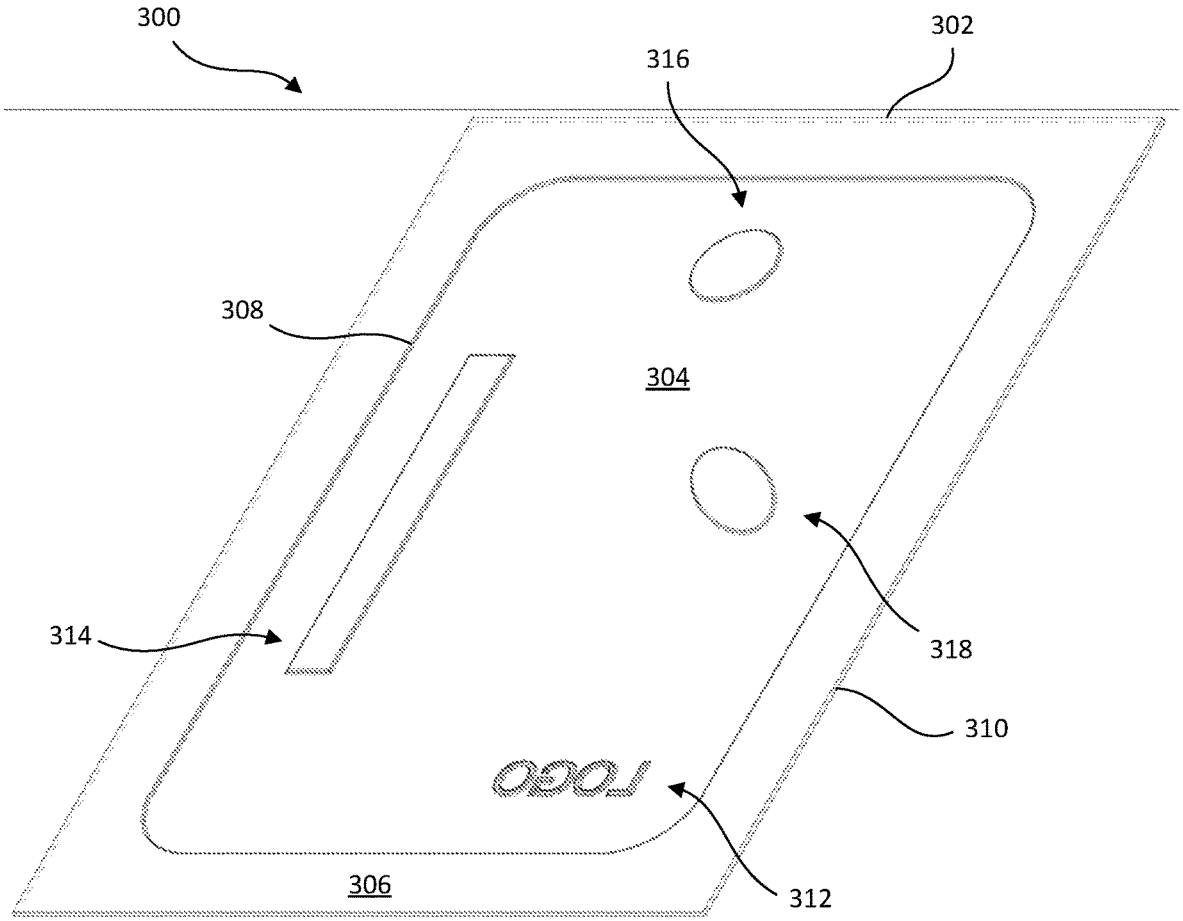
FIG. 3 is an illustration of a moulding plate used to form the resonant panel shown in FIGS. 2A and 2B.

FIG. 3 is an illustration of a moulding plate used to form the resonant panel shown in FIGS. 2A and 2B. It will be understood that the features of the moulding plate 300 correspond substantially to the features of the resonant panel described previously. The moulding plate 300 may take the place of either of the first tool plate 106 or the second tool plate 108 described with reference to FIG. 1 previously. The moulding plate 300 comprises a first pressing surface 302. The first pressing surface 302 comprises an inner region 304 and an outer region 306. The outer region 306 surrounds the inner region 304. The outer region 306 borders the inner region 304 at an interface 308. The outer region 306 extends outwards from the interface 308 to a moulding plate boundary 310. The outer region 306 is formed to have a high relief compared to the inner region 304. It will be understood that this can alternatively be expressed as the inner region 304 being formed to have a low relief compared to the outer region 306. Within the inner region 304 there are defined a plurality of localised surface features 312, 314, 316, 318. In this example, all of the localised surface features 312, 314, 316, 318 are shown having high relief relative to the inner region 304 in order to conform to the resonant panel 200 shown in FIGS. 2A and 2B. Specific features of the localised surface features 312, 314, 316, 318 are substantially as described in relation to the localised surface features in FIGS. 2A and 2B but for the fact that the localised surface features 312, 314, 316, 318 are described in the opposite sense whereby to be usable to form the resonant panel when the moulding plate 300 is used to press into a malleable resonant panel blank as described previously.

In summary, the present application provides a method of manufacturing a resonant panel (200) of a flat panel loudspeaker. The method comprises: pressing a resonant panel blank between a first pressing surface (302) and a second pressing surface of a press, whereby to form the resonant panel (200) of the flat panel loudspeaker. The second pressing surface substantially opposes the first pressing surface (302). The first pressing surface (302) comprises at least one tool relief region (306, 312, 314, 316, 318), whereby to form at least one corresponding respective panel relief region (206, 212, 214, 216, 218) in a surface of the resonant panel (200).

Throughout the description and claims of this specification, the words "comprise" and "contain" and variations of them mean "including but not limited to", and they are not intended to (and do not) exclude other moieties, additives, components, integers or steps. Throughout the description and claims of this specification, the singular encompasses the plural unless the context otherwise requires. In particular, where the indefinite article is used, the specification is to be understood as contemplating plurality as well as singularity, unless the context requires otherwise.

Features, integers, characteristics, compounds, chemical moieties or groups described in conjunction with a particular aspect, embodiment or example of the disclosure are to be understood to be applicable to any other aspect, embodiment or example described herein unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The extent of the disclosure is not restricted to the details of any foregoing embodiments. The extent of the disclosure extends to any novel one, or any novel combination, of the features disclosed in this specification (including any accompanying claims, abstract and drawings), or to any novel one, or any novel combination, of the steps of any method or process so disclosed.

The invention claimed is:

1. A method of manufacturing a resonant panel of a flat panel loudspeaker comprising:

pressing a resonant panel blank between a first pressing surface and a second pressing surface of a press, wherein the second pressing surface substantially opposes the first pressing surface, and curing the resonant panel blank between the first and second pressing surfaces, whereby to form the resonant panel of the flat panel loudspeaker, wherein the first pressing surface comprises at least one tool relief region, whereby to form at least one corresponding respective panel relief region in a surface of the resonant panel, wherein the resonant panel blank comprises:

a first skin having an outer surface in direct contact with the first pressing surface during the pressing and an inner surface directly contacting a pre-preg core;

the pre-preg core; and a second skin having an outer surface in direct contact with the second pressing surface during the pressing and an inner surface directly contacting the pre-preg core.

2. The method of claim 1, wherein a one of the at least one tool relief regions is a region of low relief, whereby to form a corresponding one of the at least one panel relief regions as a region of high relief.

3. The method of claim 1, wherein a one of the at least one tool relief regions is a region of high relief, whereby to form a corresponding one of the at least one panel relief regions as a region of low relief.

4. The method of claim 3, wherein the region of high relief extends to a lateral pressing boundary of the first pressing surface, the lateral pressing boundary corresponding to a lateral panel boundary of the surface of the resonant panel.

5. The method of claim 4, wherein the region of high relief extends to substantially all the lateral pressing boundary of the first pressing surface, whereby to form a depressed surface feature along substantially all the lateral panel boundary of the surface of the resonant panel.

6. The method of claim 1, wherein one or more of the panel relief regions defines one or more respective localised surface features within the surface of the resonant panel.

7. The method of claim 6, wherein the localised surface feature is bounded inside an inner region of the surface of the resonant panel, the inner region of the resonant panel bounded by an outer region of the surface of the resonant panel.

8. The method of claim 1, wherein the first pressing surface is defined by a pressing insert, the pressing insert being provided on a separate pressing plate.

9. A flat panel loudspeaker for mounting in a mounting surface, the flat panel loudspeaker comprising:

a speaker unit comprising a resonant panel, the resonant panel having a front surface arranged to face outwardly in the mounting surface when the flat panel loudspeaker is mounted in the mounting surface and a rear surface opposite the front surface, wherein the front surface or the rear surface comprises at least one panel relief region, wherein the resonant panel is formed by moulding or pressing and curing during the moulding or pressing, and wherein the resonant panel comprises:

a first skin defining the front surface of the resonant panel, wherein the first skin is directly contacting a pre-preg core;

the pre-preg core; and a second skin defining a rear surface of the resonant panel, wherein the second skin is directly contacting the pre-preg core.

10. The flat panel loudspeaker of claim 9, wherein the panel relief region is on the front surface and extends to a lateral boundary of the front surface.

11. The flat panel loudspeaker of claim 9, wherein the front surface comprises an inner region and an outer region surrounding the inner region, and wherein the panel relief region extends from an intersection boundary between the inner region and the outer region to the boundary of the front surface.

12. The flat panel loudspeaker of claim 11, wherein the panel relief region is a depression and wherein the depression is formed to have a substantially uniform depth.

13. The flat panel loudspeaker of claim 12, wherein a depth of the depression is less than 2 millimetres.

14. The flat panel loudspeaker of claim 10, wherein the skin is formed from paper.

* * * * *